US006378980B1

(12) United States Patent
Ha

(10) Patent No.: US 6,378,980 B1
(45) Date of Patent: Apr. 30, 2002

(54) PRINTER CAPABLE OF PREVENTING DRYING OF NOZZLE AND CONTROL METHOD THEREOF

(75) Inventor: Jong-Ho Ha, Suwon (KR)

(73) Assignee: Samsung Electronics Co., Ltd., Suwon City (KR)

( * ) Notice: Subject to any disclaimer, the term of this patent is extended or adjusted under 35 U.S.C. 154(b) by 0 days.

(21) Appl. No.: 09/572,892

(22) Filed: May 18, 2000

(51) Int. Cl.[7] ..... B41J 2/165
(52) U.S. Cl. ..... 347/23
(58) Field of Search ..... 347/9, 12, 14, 347/22, 23

(56) References Cited

U.S. PATENT DOCUMENTS

| | | | |
|---|---|---|---|
| 4,684,963 | A | 8/1987 | Naka |
| 4,734,718 | A | 3/1988 | Iwagami et al. |
| 4,791,437 | A | 12/1988 | Accattino et al. |
| 4,935,753 | A | 6/1990 | Lehmann et al. |
| 4,947,187 | A | 8/1990 | Iwagami |
| 5,027,134 | A | 6/1991 | Harmon et al. |
| 5,081,472 | A | 1/1992 | Fisher |
| 5,146,243 | A | 9/1992 | English et al. |
| 5,517,218 | A | 5/1996 | Lehna et al. |

FOREIGN PATENT DOCUMENTS

| | | | |
|---|---|---|---|
| JP | 10-250064 | * | 9/1998 |

* cited by examiner

*Primary Examiner*—Huan Tran
(74) *Attorney, Agent, or Firm*—Robert E. Bushnell, Esq.

(57) ABSTRACT

A printer that prevents the drying of nozzles of an unused micro injecting device in an inkjet printer provided with a plurality of micro injecting devices, during printing, and a control method thereof. The object of this invention is to prevent drying of nozzles without moving the micro injecting device to a maintenance location and spraying a small amount of ink during a printing operation. The printer includes a plurality of micro injecting devices provided with a plurality of nozzles that receive nozzle drive data to drive the nozzles and spray ink; a plurality of micro injecting device drivers that provide the nozzle drive data for controlling the spraying of the nozzles and making the ink inside the nozzles move up and down; a carriage that is mounted with the plurality of micro injecting devices and reciprocates side to side above the paper; a control section that drives the unused micro injecting device among the plurality of micro injecting devices to make the ink move up and down. Accordingly, nozzle drying is prevented without moving the micro injecting device to a maintenance location and spraying a small amount of ink during a print operation.

13 Claims, 6 Drawing Sheets

PRINTER CAPABLE OF PREVENTING DRYING OF NOZZLE AND CONTROL METHOD THEREOF

BACKGROUND OF THE INVENTION

1. Field of the Invention

This invention relates to an inkjet printer, and more particularly, in an inkjet printer that is provided with a plurality of micro injecting devices, to a printer that prevents drying of nozzles of the micro injecting devices that are not in use during printing and to a control method of the same.

2. Prior art

Generally, a micro injecting device is designed to apply electric and thermal energy of a certain magnitude to the object and induce volume change in the object to thereby enable adequate supply of the item of a very small amount to the intended object, such as supplying ink, injection fluid, gasoline and the like to certain objects such as paper, human bodies and automobiles.

Recently, with the aid of development in electric and electronic technology, these micro injecting devices are also being developed at a faster rate, and are being applied to a wide range of application of everyday life. An example of the application of micro injecting devices in everyday life would be an inkjet printer.

Unlike the existing dot matrix printer, an inkjet printer that utilizes micro injecting devices has many advantages that include being able to portray various colors according to the use of the micro injecting devices, a lower noise level and a higher printing quality, and for those reasons the use range thereof is tending to increase.

Generally, the size of an inkjet printer is determined by the dimensions of the paper being used, and electronic control of the precise mechanical mechanisms and the semiconductor chip circuit is required for paper insertion, paper advance and reverse, and paper supply. However, the printing portion is simply made up of the micro injecting devices that are provided with an ink container and nozzles, along with the paper which is fed to the nozzles at a 0.4–0.7 mm spacing.

The water based ink contained in the ink container flows into a small chamber within the nozzle, and when an electric signal is applied to a piezo element or thermal element, the ink expands due to pressure/heat and is linearly sprayed and printed, and the printer controller moves the micro injecting devices formed of a nozzle assembly to the next position. The nozzle assembly usually includes 32–64 parallel arranged nozzles that have a diameter of 40–60 $\mu$m, respectively. That is, the micro injecting device includes nozzles that pass ink through and a spraying means that spray ink to the outside through the nozzles.

The inkjet printer which creates a picture by spraying water based ink through the nozzles, is classified according to the way in which the ink is sprayed, roughly by the thermal method printer and the piezo aqueous method printer.

The thermal method is a method in which the ink is instantly heated to a high temperature of 200–300° C. and then sprayed, where air bubbles are generated by instant heating caused from an electric signal that is applied to the resistor of the micro injecting device. Through the force of these air bubbles, the ink is pushed out of the nozzles that compose the micro injecting device and is printed on paper.

On the other hand, in the piezo aqueous method, when an electric impulse is applied to the piezo element in the micro injecting device, the element vibrates, and as a consequence of this vibration, the ink exits the nozzles of the micro injecting device and prints on the paper. The micro injecting device initially absorbs the ink poured into an ink cartridge and then the ink is supplied by surface tension, capillary effect and impulse of the absorbed ink.

As depicted in FIG. 1, for printing operations, the color inkjet printer performs color printing by placing two micro injecting devices, namely, a micro injecting device 4*a* for black and white printing and a micro injecting device 4*b* for color printing, on to a carriage 3, coupling the carriage 3 on to a timing belt 2 which is connected to a motor 1, and spraying ink on to paper (a) through nozzles of the color or black/white micro injecting device according to the methods mentioned above while reciprocating the devices side to side along a guide shaft 6.

Generally, in inkjet printers which use two micro injecting devices for printing, one micro injecting device does not print while the other micro injecting device is being used to print.

For example, while printing is being performed on paper (10) by spraying black ink through the use of the black micro injecting device 4*a*, the color micro injecting device 4*b* is not used and is exposed to the ambient air.

Thus, in case the unused micro injecting device is left exposed to air for a long time, a problem arises when the nozzles of the micro injecting device become dry.

To prevent this, while one micro injecting device is printing and the other micro injecting device is left unused and exposed to the air for a certain amount of time, the method of temporarily stopping the printing operation and moving the unused micro injecting device to a maintenance location 7 and spraying a certain amount of ink was used.

However, the above method increased ink consumption due to needless ink spraying and slowed down print data printing speed due to movements that have no connections to the actual printing during the print data printing operation.

In addition, the maintenance location is generally installed with many structures having technical collision characteristics and this causes the problem of noise.

SUMMARY OF THE INVENTION

Therefore, the present invention has been made to overcome the above conventional problems, and it is an object of the present invention to prevent drying of the nozzles without moving the unused micro injecting device to a maintenance location and spraying a small amount of ink during printing.

The above object is accomplished by a printer capable of preventing drying of nozzle according to one aspect of the present invention, including a plurality of micro injecting devices provided with a plurality of nozzles that receive nozzle drive data to drive the nozzles and spray ink; a plurality of micro injecting device drivers that provide the nozzle drive data for controlling the spraying of the nozzles and making the ink inside the nozzles move up and down; a carriage that is mounted with the plurality of micro injecting devices and reciprocates side to side above the paper; a control section that drives the unused micro injecting device among the plurality of micro injecting devices to make the ink move up and down.

Preferably, the control section drives the unused micro injecting device in the acceleration and deceleration regions of the carriage to make ink move up and down.

Preferably, the plurality of micro injecting devices consist of a color micro injecting device for color printing and a black and white micro injecting device for black and white printing.

The above object is also accomplished by a nozzle drying preventing method according to another aspect of the present invention, for a printer provided with a plurality of micro injecting devices mounted on a carriage and which reciprocate side to side above the surface of paper, including the steps of driving the corresponding micro injecting device when a print command is generated, driving the unused micro injecting devices among the plurality of micro injecting devices and making the ink move up and down.

Preferably, the step of driving the unused micro injecting device drives the unused micro injecting devices in the acceleration and deceleration regions of the carriage to make ink move up and down.

Preferably, the plurality of micro injecting devices consist of a color micro injecting device for color printing and a black and white micro injecting device for black and white printing.

BRIEF DESCRIPTION OF THE DRAWINGS

The above objects and features of this invention will become more apparent through detailed descriptions of the preferred embodiments and with reference to the drawings annexed hereto.

DETAILED DESCRIPTION OF THE PREFERRED EMBODIMENTS

The above mentioned objects, features and advantages of this invention are described in greater detail hereinafter through the preferred embodiments depicted in the annexed drawings.

The terminology used hereinafter are defined words accounting for the functions of the present invention and may differ according to the intentions or conventions of those skilled in the art, therefore, the definitions thereof should be defined on the basis of the general content of this specification.

Figure 1:
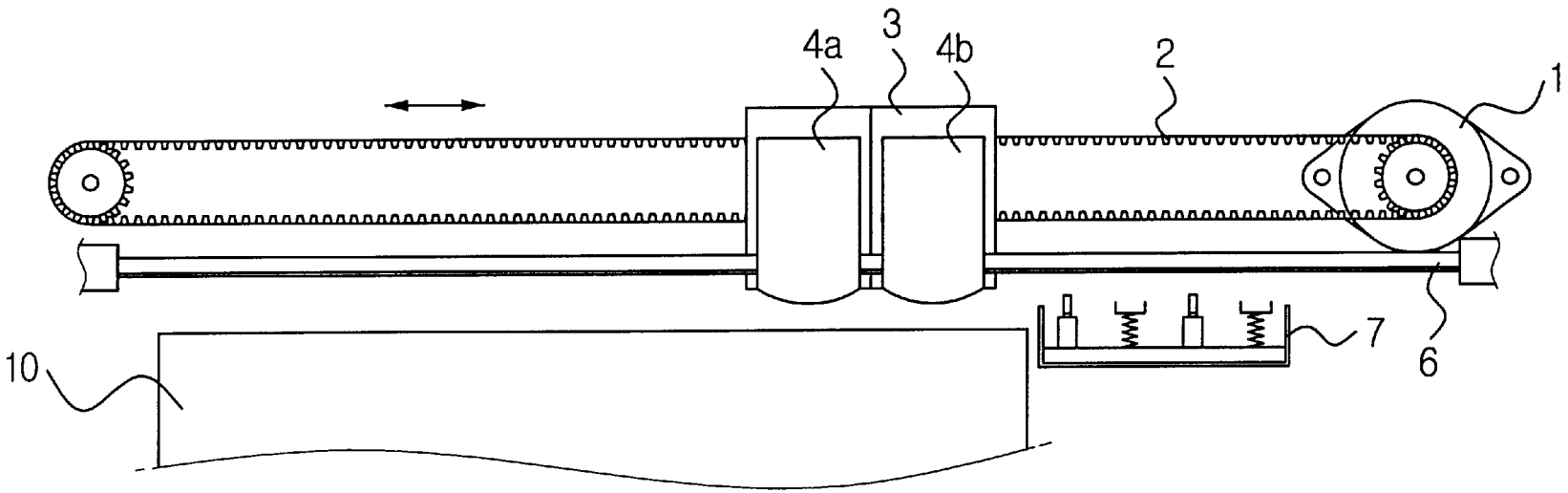
FIG. 1 shows an inkjet printer provided with two micro injecting devices.
Figure 2:
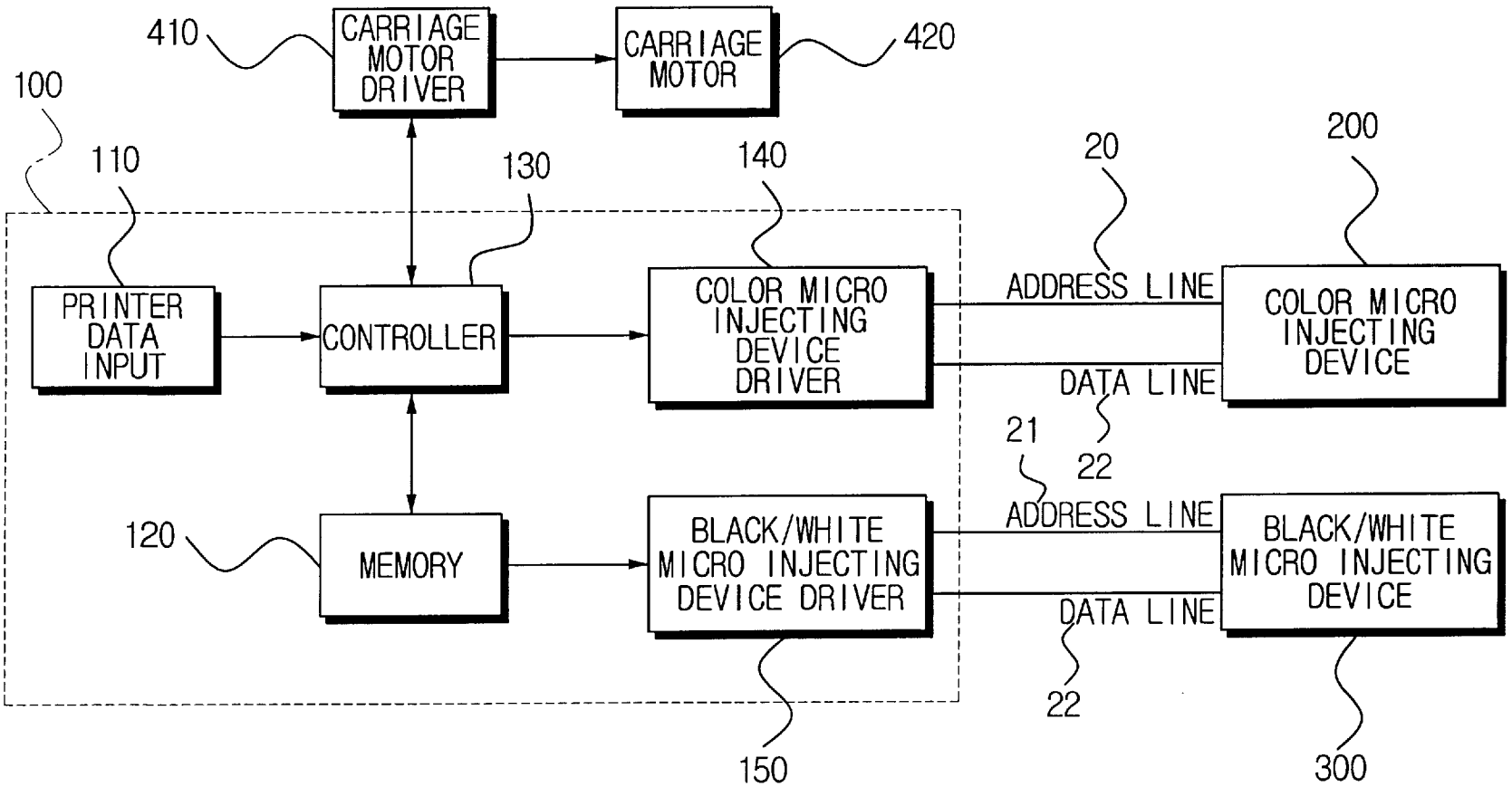
FIG. 2 shows the main components of a nozzle drying prevention printer provided with two micro injecting devices according to the present invention.

The nozzle drying prevention printer provided with two micro injecting devices according to the preferred embodiments of the present invention is described below with reference to FIG. 2.

When a print command is provided by the computer user, the computer (not shown) transmits bitmaps corresponding to each page to a printer controller 100 through a printer interface that is connected to a serial port or parallel port attached to the back of the computer.

The control section (controller) 130 of the printer controller 100 receives the bitmap data of respective pages from the host computer through the serial port or the parallel port through the print data input 110 and stores them in the memory 120.

In addition, the control section 130 selects the micro injecting device that will perform operations among the micro injecting devices color 200 and (black and white) 300 and conveys the print data (for example, print location data for printing on paper) of the bitmap data stored in the memory 120 to the micro injecting device driver of the corresponding selected micro injecting device.

For example, if color printing is being performed, when the control section 130 selects the color micro injecting device driver 140 and provides the print data, the color micro injecting device 200 drives the relevant nozzles and sprays the ink.

The color micro injecting device 200 is provided with a plurality of nozzles 52 and performs color printing by receiving nozzle drive data and driving the nozzles and spraying color ink. The black and white micro injecting device 300 is provided with a plurality of nozzles 52 and performs black and white printing by receiving nozzle drive data and driving the nozzles 52 and spraying black and white ink.

Figure 6:
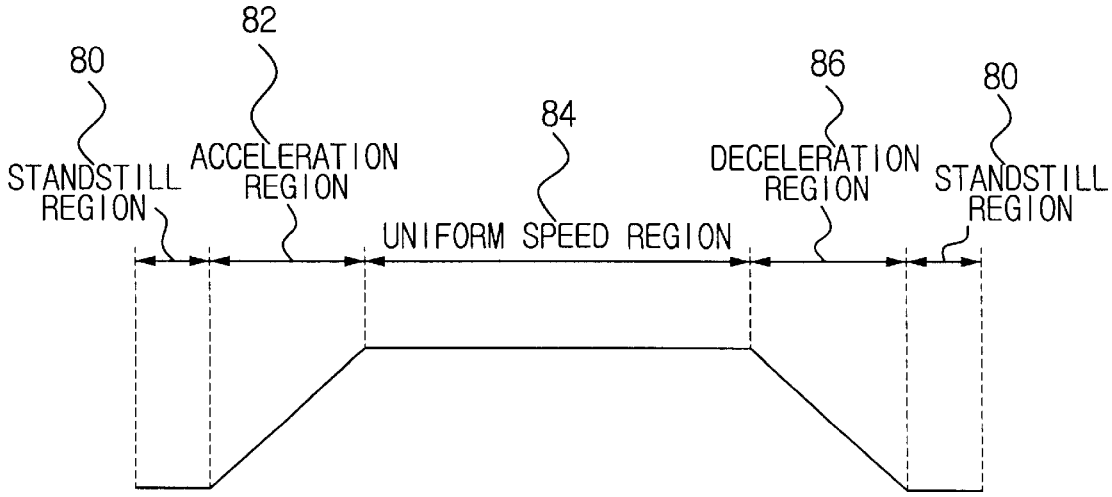
FIG. 6 shows the variation in carriage speed and print regions.
Figure 7:
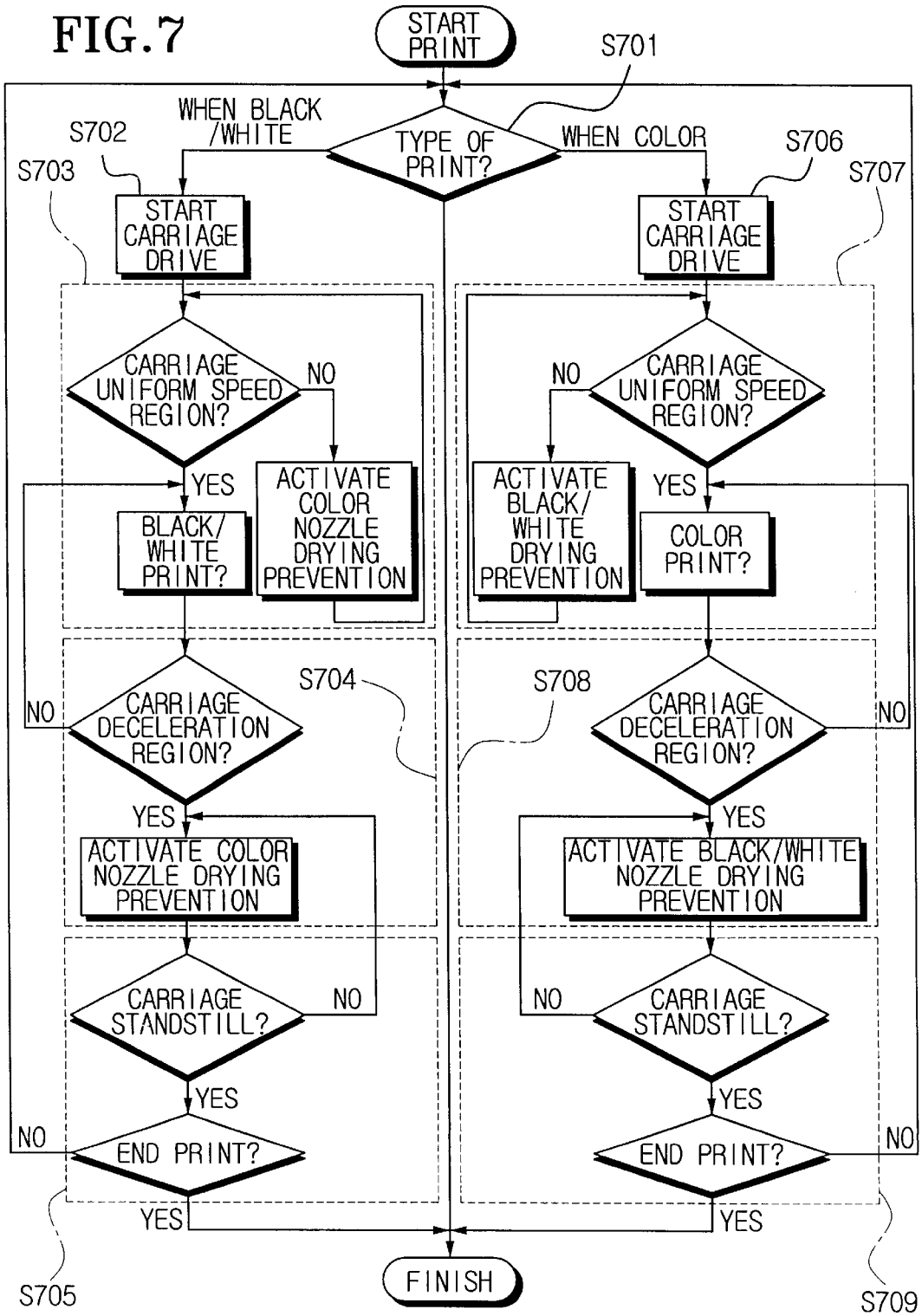
FIG. 7 shows the control method of the nozzle drying prevention printer according to the present invention.

The carriage motor driver 410 drives the carriage motor 420 according to the controls of the control section 130 and reciprocates the carriage (not shown) which mounts the color micro injecting device 200 and the black/white micro injecting device, from side to side divided by stop region (standstill region) 80, acceleration region 82, uniform speed region 84, and deceleration region 86 above the paper, as shown FIG. 6.

The color micro injecting device the driver 140 and the black and white micro injecting device driver 150 control the ink spraying of the nozzles formed in the color micro injecting device 200 and the black and white micro injecting device 300 corresponding to the print location data that is conveyed from the control section 130, and transmits the nozzle drive data to the color micro injecting device 200 and 300 to make the ink in the nozzle interior move up and down as depicted in FIG. 5.

In addition, the control section 130 drives the unused micro injecting device among the color injecting device 200 and the black and white micro injecting device 300, through the corresponding micro injecting device driver, and makes the ink in the nozzles move up and down.

Figure 3:
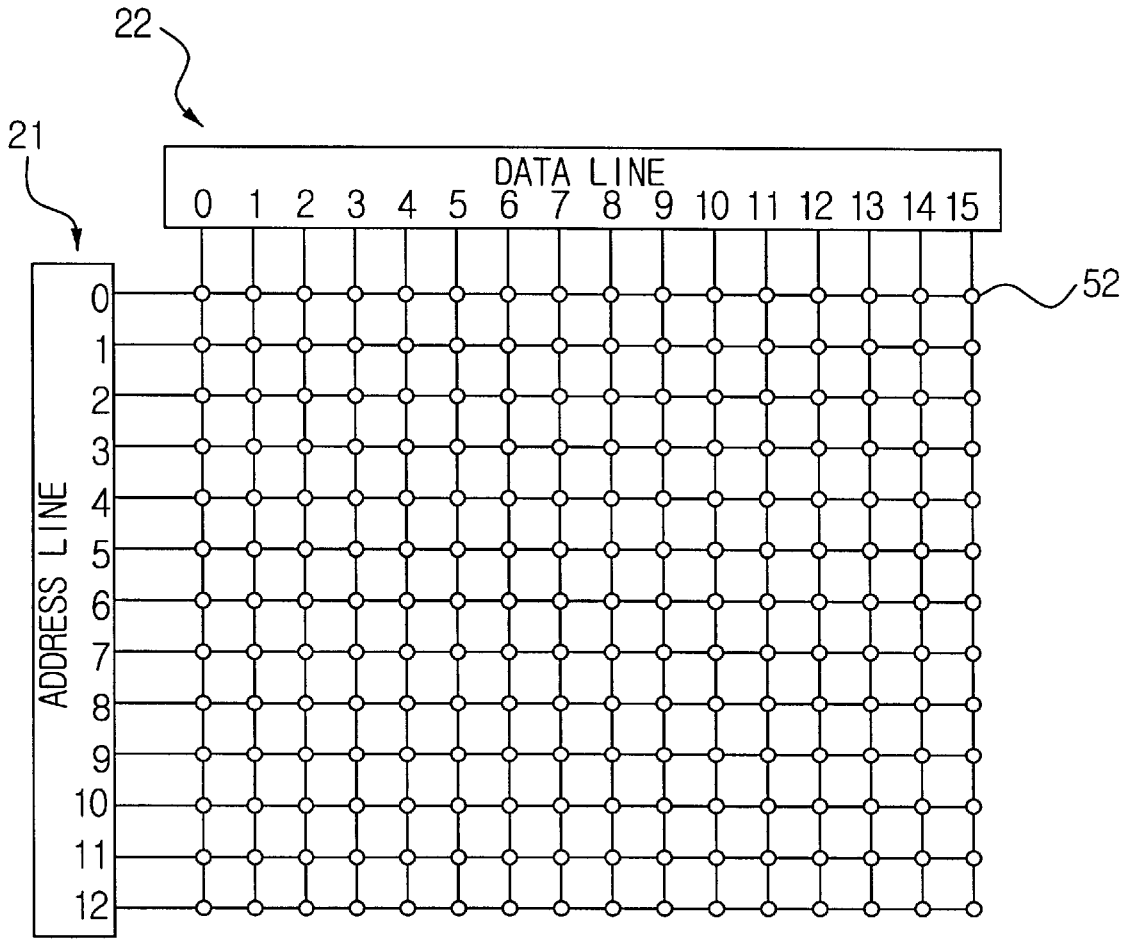
FIG. 3 is a conceptual diagram indicating the driving principles of the micro injecting device.

The driving principle of the nozzles 52 of the micro injecting device is that the relevant nozzles 52 are driven according to the nozzle drive data inputted through the data lines 22 and address lines 20, as shown in FIG. 3.

As shown, if there are sixteen data lines and thirteen address lines, the total number of nozzles 52 for the micro injecting device is 13×16=208. The nozzles 52 are organized where the data lines 22 and the address lines 20 intersect such that the nozzles 52 are driven when the data lines 22 and address lines 20 are activated simultaneously.

Figure 4:
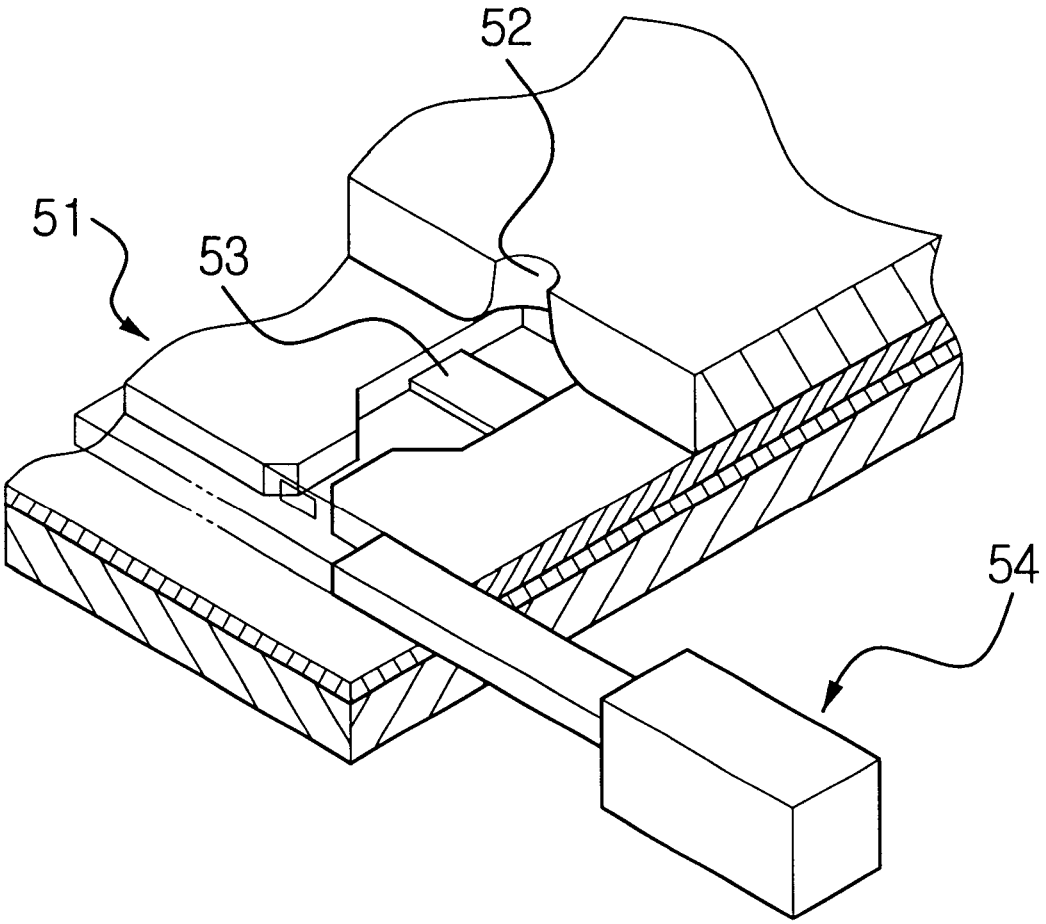
FIG. 4 is a partial diagram of the micro injecting device.
Figure 5A:
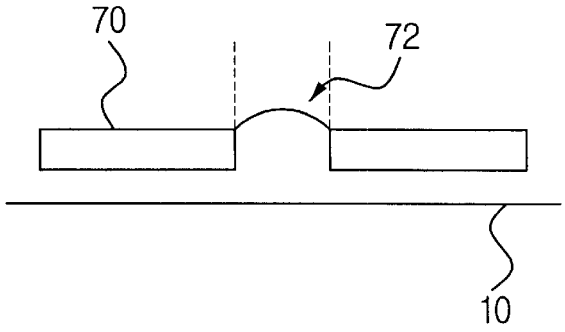
FIGS. 5*a* and 5*b* show the moving shape of the ink according to the present invention.
Figure 5B:
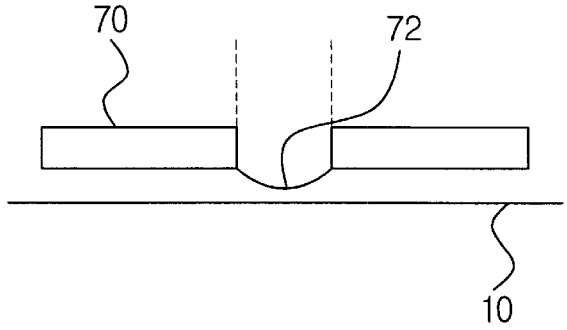

Now, the spraying amount of ink will be proportional to the activation time of the data lines 22 and address lines 20, and therefore, the activation cycle that makes the ink move up and down without being sprayed, as shown in FIGS. 5*a* and 5*b*, is determined by the activation sustaining time of the data lines 22 and address lines 20. The time is approximately 300 ns, and this differs depending on given conditions such as driver circuits of respective ink and micro injecting device manufacturers, With reference to FIG. 4, a portion of the micro injecting device can be observed to have a nozzle 52 with a microscopic diameter, and a method is used in which a heating resistor 53 is heated for a set time by an external power source and ink which is supplied in the storage case 54 is heated by the heating resistor 53 and thereby air bubbles are formed in the interior of the nozzle 52, and as the size of the air bubbles become greater, ink is pushed out of the nozzle 52 and spouted out on to the paper 10.

For the heating resistor, a set resistance value and a set heating time are required so that the ink can be sprayed as an appropriate droplet, and the micro injecting device drivers 140 and 150 adjust these values and control the ink so that the ink is not sprayed and moves up and down as shown in FIGS. 5A and 5B.

The control method of the nozzle drying prevention printer according to the present invention, when applied to a printer provided with color/black micro injecting devices and with reference to the annexed drawings, is as follows.

Firstly, whether the printing operation is color or black/white is determined (step S701).

According to the result, if it is a black/white printing operation, driving of the carriage is initiated (step S702).

Successively, when the driven carriage reaches the uniform speed region 84, black/white printing is done, and if it does not reach the uniform speed region 84, the color micro injecting device 200 is driven for a predetermined time so that the drying of the color nozzles are prevented by not allowing the ink to get sprayed to the exterior of the nozzles 52 such that the ink moves up and down within the nozzles 52 (step S703).

In addition, when the carriage reaches the deceleration region 86 after one line of printing is completed when the black/white printing has been performed in the uniform speed region 84, the drying of the color nozzles is prevented as mentioned above (step S704).

Successively, when the carriage comes to a standstill 80, whether there is more printing to be done is determined and if there is more printing to be done, it returns to step S701, and if not, printing is completed (step S705).

On the other hand, as a result of step S701, if the print operation is color printing, the driving of the carriage is initiated (step S706).

Successively, when the driven carriage reaches the uniform speed region 84, color printing is done, and if it does not reach the uniform speed region 84, the black/white micro injecting device 300 is driven for a predetermined time so that the drying of the black/white nozzles is prevented by not allowing the ink to get sprayed to the exterior of the nozzles 52 such that the ink moves up and down within the nozzles 52 (step S707).

In addition, when the carriage reaches the deceleration region 86 after one line of printing is completed when the color printing has been performed in the uniform speed region 84, the drying of the black/white nozzles is prevented as mentioned above (step S708).

Successively, when the carriage comes to a standstill 80, whether there is more printing to be done is determined and if there is more printing to be done, it returns to step S701, and if not, printing is completed (step S709).

As discussed above, according to the present invention, prevention of nozzle drying can result without moving the unused micro injecting device to a maintenance location and spraying a small amount of ink during a printing operation.

It is to be understood, however, that even though the present invention has been described with reference to the annexed drawings that depict the preferred embodiments thereof, the present invention is not limited to the said embodiments, and may apparently be modified in many ways by those ordinarily skilled in the art without departing from the general principle and scope of the invention expressed in the appended claims.

What is claimed is:

1. A nozzle drying prevention printer, comprising:

a plurality of micro injecting devices having a plurality of nozzles, said plurality of micro injecting devices receiving nozzle drive data to drive said nozzles and spray ink;

a plurality of micro injecting device drivers providing said nozzle drive data controlling the spraying of said nozzles and making the ink inside said nozzles move up and down;

a carriage mounting said plurality of micro injecting devices and reciprocating side to side above a printable medium; and a control section driving the unused micro injecting device among said plurality of micro injecting devices to make the ink move up and down, said control section driving said unused micro injecting device in acceleration and deceleration regions of said carriage to make ink move up and down.

2. A method for preventing nozzle drying in a printer, comprising the steps of:

driving a corresponding micro injecting device when a print command is generated, the micro injecting device among a plurality of micro injecting devices mounting on a carriage and reciprocating side to side above a surface of a printable medium; and driving an unused micro injecting device among said plurality of micro injecting devices and making the ink move up and down, wherein said step of driving said unused micro injecting device driving said unused micro injecting device in the acceleration and deceleration regions of said carriage to make ink move up and down.

3. A nozzle drying prevention printer, comprising the steps of:

a plurality of micro injecting devices having a plurality of nozzles, said plurality of micro injecting devices receiving nozzle drive data to drive said nozzles and spray ink;

a plurality of micro injecting device drivers providing said nozzle drive data controlling the spraying of said nozzles and making the ink inside said nozzles move up and down;

a carriage mounting said plurality of micro injecting devices and reciprocating side to side above a printable medium;

a control section driving the unused micro injecting device among said plurality of micro injecting devices to make the ink move up and down; and a resistor heating the ink within a storage case holding the ink, the resistance value and the heating time being adjusted and the ink controlled by the corresponding micro injecting device driver so the ink moves up and down within the nozzles of the unused micro injecting device and the ink does not spray on the printable medium.

4. A method for preventing nozzle drying in a printer, comprising the steps of:

driving a corresponding micro injecting device when a print command is generated, the micro injecting device among a plurality of micro injecting devices mounting on a carriage and reciprocating side to side above a surface of a printable medium; and driving an unused micro injecting device among said plurality of micro injecting devices and making the ink move up and down, said unused micro injecting device making the ink move up and down in the nozzle interior without ejection of the ink on to the printable medium, said unused micro injecting device not moving the ink up and down when said carriage is traveling a uniform speed.

5. A method for preventing nozzle drying in a printer, comprising the steps of:

driving a corresponding micro injecting device when a print command is generated, the micro injecting device among a plurality of micro injecting devices mounting on a carriage and reciprocating side to side above a surface of a printable medium; and driving an unused micro injecting device among said plurality of micro injecting devices and making the ink move up and down, with said step of driving the unused micro injecting device further comprising the step of adjusting a resistance value of a resistor and heating time of the ink by the resistor in accordance with limiting the ink to move up and down within the unused micro injecting device and not spraying the ink on the printable medium.

6. A method for preventing nozzle drying in a printer, comprising the steps of:

driving a corresponding micro injecting device when a print command is generated, the micro injecting device among a plurality of micro injecting devices mounting on a carriage and reciprocating side to side above a surface of a printable medium; and driving an unused micro injecting device among said plurality of micro injecting devices and making the ink move up and down, wherein said step of driving said unused micro injecting device driving said unused micro injecting device in the acceleration and deceleration regions of said carriage to make ink move up and down, with said step of driving the unused micro injecting device further comprising the step of adjusting a resistance value of a resistive element and heating time of the ink by the resistive element in accordance with limiting the ink to move up and down within the unused micro injecting device and not spraying the ink on the printable medium.

7. A method, comprising the steps of:

determining whether a printing operation uses a first or second ink unit in a printer, the first and second ink units being used to transfer ink to a printable medium;

selecting a first ink unit by a controller of said printer according to image data sent to the controller;

initializing a carriage when the first ink unit is selected, the carriage reciprocating side to side above the printable medium, the carriage having both first and second ink units;

determining whether the carriage is traveling at a uniform speed;

printing on the printable medium using ink from the first ink unit when carriage is traveling at the uniform speed; and preventing the ink from drying in the unused second ink unit when carriage is not traveling at a uniform speed.

8. The method of claim 7, with said step of preventing ink from drying being the moving up and down of the ink within the unused second ink unit.

9. The method of claim 7, with said step of preventing ink from drying further comprising the step of adjusting a resistance value of a resistor and heating time of the ink by the resistor in accordance with limiting the ink to move up and down within the unused second ink unit and not spraying the ink on the printable medium.

10. The method of claim 7, with said step of preventing ink from drying, further comprising the steps of:

driving the second unit with a corresponding ink unit driver;

adjusting a resistance value of a resistor by the ink unit driver;

heating the resistor by an external power source;

supplying ink to a storage case of the unused second ink unit;

heating the ink in the storage case by the resistor; and adjusting the heating time of the ink, the adjusting of the heating time, the adjusting of the resistance value of the resistor, and the controlling of the ink by the ink unit driver are set to form bubbles inside the unused second ink unit to move the ink up and down within the unused second ink unit without spraying onto the printable medium.

11. The method of claim 10, with the second ink unit having a plurality of nozzles, the ink moving up and down within the interior of the nozzle.

12. The method of claim 11, with the carriage traveling at a uniform speed on a first set region on the path of the carriage, a second set region preceding the first set region, the carriage accelerating on the second set region, a third set region proceeding the first set region, the carriage decelerating on the third set region, the ink moving up and down without spraying onto the printable medium within the second and third set regions of the path of the carriage.

13. The method of claim 7, with the carriage traveling at a uniform speed on a first set region on the path of the carriage, a second set region preceding the first set region, the carriage accelerating on the second set region, a third set region proceeding the first set region, the carriage decelerating on the third set region, the ink moving up and down without spraying onto the printable medium within the second and third set regions of the path of the carriage.

* * * * *